US008881468B2

(12) United States Patent
McMullen

(10) Patent No.: US 8,881,468 B2
(45) Date of Patent: Nov. 11, 2014

(54) FIXTURE WALL MOUNT ASSEMBLY WITH INTEGRAL FLASHING

(75) Inventor: Brian K. McMullen, Waxhaw, NC (US)

(73) Assignee: Tapco International Corporation, Wixom, MI (US)

( * ) Notice: Subject to any disclaimer, the term of this patent is extended or adjusted under 35 U.S.C. 154(b) by 411 days.

(21) Appl. No.: 13/119,910

(22) PCT Filed: Sep. 18, 2009

(86) PCT No.: PCT/US2009/057455

§ 371 (c)(1),
(2), (4) Date: Jun. 13, 2011

(87) PCT Pub. No.: WO2010/033787

PCT Pub. Date: Mar. 25, 2010

(65) Prior Publication Data

US 2011/0240813 A1 Oct. 6, 2011

Related U.S. Application Data

(60) Provisional application No. 61/098,485, filed on Sep. 19, 2008, provisional application No. 61/116,712, filed on Nov. 21, 2008.

(51) Int. Cl.

| | |
|---|---|
| ***E04D 1/36*** | (2006.01) |
| ***F21V 21/02*** | (2006.01) |
| *F21V 33/00* | (2006.01) |
| *E06B 1/62* | (2006.01) |

(52) U.S. Cl.

CPC . *E06B 1/62* (2013.01); *F21V 21/02* (2013.01); *F21V 33/006* (2013.01); *E06B 2001/628* (2013.01)

USPC ..... 52/61; 52/97; 52/60; 52/62; 52/302.1; 248/224.8

(58) Field of Classification Search

USPC ..... 248/224.8, 220.21, 220.22; 52/61, 97, 52/58, 60, 62, 302.1, 302.6; 403/321

See application file for complete search history.

(56) References Cited

U.S. PATENT DOCUMENTS

| | | | |
|---|---|---|---|
| 2,167,419 | A | 7/1939 | Heanes |
| 3,180,595 | A | 4/1965 | Brunsting et al. |
| 4,156,272 | A | 5/1979 | Wandler |
| 4,265,365 | A | 5/1981 | Boteler |
| 4,336,673 | A | 6/1982 | Duchesne et al. |
| 4,635,168 | A | 1/1987 | Crowley |
| 4,726,152 | A | 2/1988 | Vagedes et al. |

(Continued)

OTHER PUBLICATIONS

Website: http://www.duraflo.com/Duraflo.aspx?categoryID=89, accessed on Jul. 14, 2011.

(Continued)

*Primary Examiner* — Todd M Epps
(74) *Attorney, Agent, or Firm* — Quinn Law Group, PLLC

(57) ABSTRACT

A fixture mounting assembly includes a mounting bracket for attaching, via a flange, to the outside wall of a building under construction. A mounting block for holding the fixture in place against the wall fits within the mounting bracket. The mounting bracket includes a flashing component extending from the front face of the mounting bracket such that the mounting block is held in place by being at least partially surrounded by the flashing component. The fixture mounting assembly is useful but not limited to construction in which fiber cement siding will surround the outside wall and the associated fixture.

21 Claims, 6 Drawing Sheets

(56) References Cited

U.S. PATENT DOCUMENTS

| | | | | |
|---|---|---|---|---|
| 4,854,093 | A | 8/1989 | Kellom | |
| 4,887,195 | A | 12/1989 | Donelan | |
| 4,920,708 | A | 5/1990 | MacLeod et al. | |
| 5,000,409 | A | 3/1991 | MacLeod et al. | |
| 5,133,165 | A | 7/1992 | Wimberly | |
| 5,221,069 | A | 6/1993 | Struthers et al. | |
| 5,275,366 | A | 1/1994 | Simmons | |
| 5,303,522 | A | 4/1994 | Vagedes | |
| 5,326,060 | A | 7/1994 | Chubb et al. | |
| 5,526,619 | A | 6/1996 | Vagedes | |
| 5,549,266 | A | 8/1996 | Mitchell et al. | |
| 5,578,791 | A | 11/1996 | Bosse, Jr. | |
| 5,722,208 | A | 3/1998 | Humphrey et al. | |
| 5,775,032 | A | 7/1998 | Lacy | |
| 5,918,431 | A | 7/1999 | Schiedegger et al. | |
| 5,947,816 | A | 9/1999 | Schiedegger et al. | |
| 6,355,882 | B1 | 3/2002 | Gretz | |
| 6,378,910 | B1 | 4/2002 | Maiman | |
| 6,417,447 | B1 | 7/2002 | Bosse, Jr. | |
| 6,825,414 | B2 | 11/2004 | Vagedes | |
| 6,951,081 | B2 * | 10/2005 | Bonshor | 52/97 |
| RE38,881 | E | 11/2005 | Chubb et al. | |
| 7,408,111 | B2 | 8/2008 | Clark et al. | |
| 7,516,576 | B1 * | 4/2009 | Mullane | 52/24 |
| 7,516,578 | B2 | 4/2009 | Bonshor | |
| 7,549,258 | B2 | 6/2009 | Lajewski | |
| 7,610,726 | B2 | 11/2009 | Lajewski | |
| 7,676,993 | B2 * | 3/2010 | Bonshor | 52/61 |
| 7,748,174 | B2 * | 7/2010 | Bonshor | 52/97 |
| 7,752,814 | B2 | 7/2010 | Bonshor | |
| 7,762,039 | B2 | 7/2010 | Hickey | |
| 7,770,854 | B2 * | 8/2010 | Bonshor | 248/205.1 |
| 7,880,085 | B2 * | 2/2011 | Nurenberg et al. | 174/66 |
| 2003/0136060 | A1 * | 7/2003 | Bonshor | 52/97 |
| 2006/0117682 | A1 | 6/2006 | Chang | |
| 2009/0320384 | A1 | 12/2009 | Chan et al. | |
| 2011/0131891 | A1 * | 6/2011 | Nurenberg et al. | 52/27 |

OTHER PUBLICATIONS

Website: http://www.primex.ca/large_products/construction/HVAC_outdoor/dv.htm, accessed on Jul. 14, 2011.

* cited by examiner

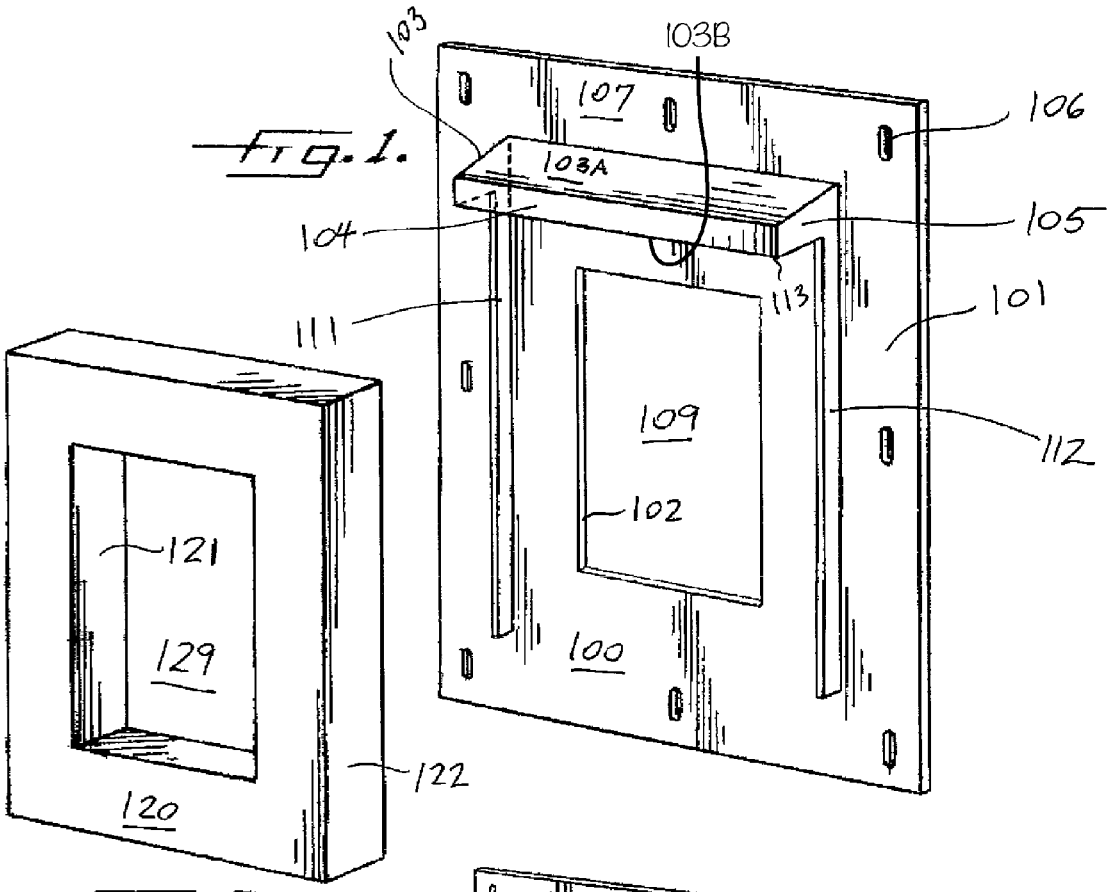
Fig. 1.
Fig. 2.
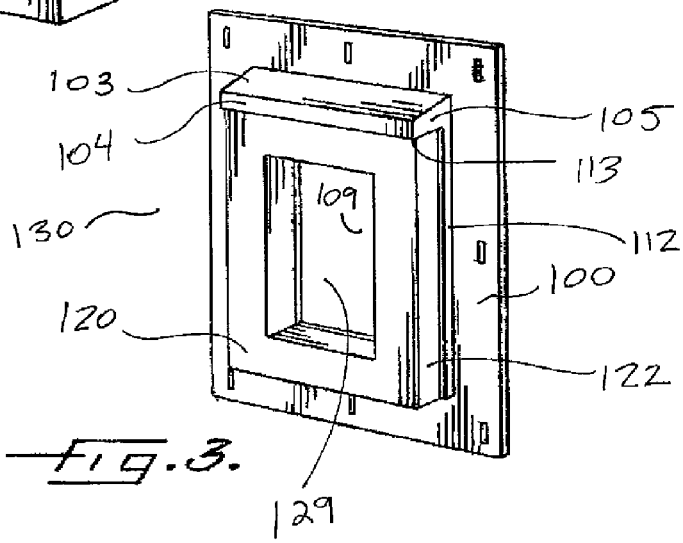
Fig. 3.

FIXTURE WALL MOUNT ASSEMBLY WITH INTEGRAL FLASHING

CROSS REFERENCE TO RELATED APPLICATIONS

This application claims priority to and all of the benefits of International Patent Application PCT/US2009/057455 filed with the World Intellectual Property Organization on Sep. 18, 2009, and entitled "Fixture Wall Mount Assembly with Integral Flashing, which claims priority to U.S. Provisional Patent Application Ser. No. 61/098,485 filed on Sep. 19, 2008, and entitled "Fixture Wall Mount Assembly with Integral Flashing" and U.S. Provisional Patent Application Ser. No. 61/116,712 filed Nov. 21, 2008, and entitled "Fixture Wall Mount Assembly with Integral Flashing." Flashing," all of which are incorporated herein by reference.

FIELD OF THE INVENTION

The invention relates to wall mount assemblies for attaching outside fixtures onto houses and other construction projects. The invention is particularly useful for mounting fixtures in conjunction with fiber cement siding.

BACKGROUND OF THE INVENTION

Modern construction projects often use synthetic materials for siding on the outside of houses and other buildings. Historically, the siding has included vinyl siding or Masonite®, but more recently, consumers have turned to newer options, such as fiber cement siding. One of the most well known fiber cement siding companies markets its product as HardiPlank™. Fiber cement siding is typically installed on the outside wall of the construction by attaching the fiber cement planks to studs for a nice exterior finish to a residence or other building.

All construction products include outside fixtures, such as lights, spigots, vents, and other utility equipment that must be accommodated within the wall construction. Likewise, the engineer installing the siding on the outside of the building must work around these fixtures. The industry, therefore, faced a need for a mechanism that allowed the fixtures to function properly and fit well with the outer siding applied to the building.

U.S. Pat. No. 4,920,708 (MacLeod 1990) shows an example of such a wall mount assembly that has been particularly useful with vinyl siding. The MacLeod device includes a main one piece bracket that is nailed or screwed to the outside wall. The bracket has a recessed front wall surrounded by peripheral edge that receives therein a mounting block, referred to in the '708 patent as a flange member. The recessed front wall defines an opening that allows the installation to match an opening in the wall for utility work. The outer edge of the bracket has nail or screw slots for attaching the bracket flush against the wall. The mounting block or flange member includes an opening that fits over the opening in the recessed front wall of the bracket. In operation, the MacLeod '708 device provides for the bracket to be nailed flush against the wall, and then the mounting block lines up the holes for the desired fixture fitting. The device is characterized by a locking, or snap-in, feature such that the mounting block has tabs that engage recesses in the bracket for sturdy assembly. The siding, most likely vinyl siding, is applied around the bracket so that the nails attaching the mounting bracket to the wall are covered. The mounting block is made of a similar material and color for an even, aesthetically pleasing transition from siding to fixture.

U.S. Pat. No. 5,000,409 (MacLeod 1991) continues along the same line as the '708 patent. In the MacLeod '409 device, however, the bracket is screwed directly into the siding. Convex bracket edges and attachment beads on diametrically opposed sides ensure proper fitting over previously installed siding. The problem with the MacLeod '409 device is that the fixture mounting assembly is entirely visible, and the siding installation crew has to be careful to remember to leave openings in the siding installation for the utility work.

In a design similar to the two patents described above, U.S. Pat. No. 5,326,060 (Chubb 1994) was reissued by the United States Patent Office as U.S. RE 38,881 (Chubb 2005). Chubb discloses a plastic building wall mount assembly having a one-piece bracket with a back wall and an integral continuous peripheral wall (i.e., the back wall is generally recessed within the peripheral wall of the bracket). Like the other embodiments noted above, Chubb attaches the bracket to the outer wall of the building during construction via an outer flange surrounding the continuous peripheral wall. The outer flange has holes or slots for mounting the bracket flush with the outer wall of the building. An inner mounting assembly slides into the continuous peripheral wall of the bracket. The mounting assembly provides an access hole that fits over a corresponding hole in the bracket assembly for fitting a utility fixture there through. Siding is installed over the outer flange of the bracket so that only the mounting assembly within the bracket is visible after completing construction. The Chubb device is characterized by the mounting block having a recessed front face surrounded by a mounting block inner wall to provide the installed light or other utility with additional protection against outside elements.

Other patents show variations of the above described designs. U.S. Pat. No. 5,947,816 (Schiedegger 1999) shows a modular soffit vent for use with siding on houses, and U.S. Pat. No. 7,408,111 (Clark 2008) shows a mounting bracket with venting for a dryer or other exhaust.

Notably, a number of prior mounting assemblies require extensive trimming components that are separate from the actual fixture mounting. In other words, to give a polished look, the mounting assemblies require yet another piece that must be purchased and installed. See, e.g., U.S. Pat. No. 5,133,165 (Wimberly 1992); U.S. Pat. No. 5,549,266 (Mitchell 1996); and U.S. Pat. No. 5,918,431 (Schiedegger 1999).

Given that in regard to utility fixtures, one size does not fit all, fixture installations benefit from modular designs that allow for proper sizing of each piece. Unfortunately, the prior mounting assemblies shown in publications to date include fixed, non-detachable pieces that engage the fixture. As such, the installer has no flexibility to customize the fixture and protective siding job. See, e.g., U.S. Pat. No. 5,578,791 (Bosse, Jr. 1996)(showing a fixed conduit box); U.S. Pat. No. 6,951,081 (Bonshor 2005)(showing fixed bracket assembly requiring trim component); and U.S. Pat. No. 7,516,578 (Bonshor 2009)(showing a mounting assembly with a fixed mounting block that cannot be adjusted for variously sized fixtures).

A need exists, therefore, for a fixture mounting assembly that provides access to the wall of the structure, a place for fixtures to be mounted with precision, and a mechanism for installing newer types of siding, such as HardiPlank™, around the mounting assembly with a continuous and seamless appearance upon completion. The prior efforts in this regard fail to completely protect the utility fixtures at issue due to the contoured shapes of the mounting devices used therein.

BRIEF SUMMARY OF THE INVENTION

The invention herein is a mounting assembly for use in protecting a fixture connected to the outside wall of a building. The mounting assembly includes a mounting bracket for attaching to the wall of a building, and the mounting bracket defines an opening for a fixture attached to the building to fit through the mounting bracket. The mounting bracket has a flashing component that adds to the weather proofing nature of the invention. A detachable mounting block fits over the mounting bracket and into the flashing component. The mounting block defines an opening that allows a securely engaged fit for the fixture through the mounting block. This secure fit, defined by the mounting block engaging the applicable fixture, provides a higher degree of protection for the fixture from the elements.

BRIEF DESCRIPTION OF THE DRAWINGS

FIG. 1 is a perspective view of a wall bracket with integral flashing component in accordance with this invention.

FIG. 2 is a perspective view of a fixture mounting block that fits into the bracket of FIG. 1 in accordance with this invention.

FIG. 3 is a perspective view of the completed assembly including the modular pieces of FIGS. 1 and 2.

DETAILED DESCRIPTION

Figure 4:
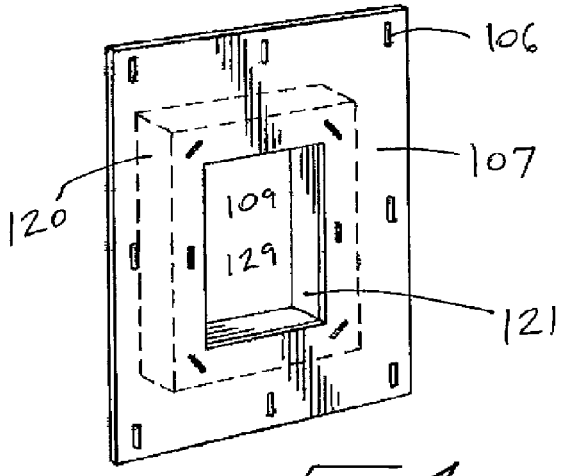
FIG. 4 is a rear view of the mounting assembly of FIG. 3 with the mounting block in place on the opposite side.

The invention is a fixture mounting assembly (130) for attaching to the outside wall of a building (shown separately in FIGS. 1 and 2 as 100, 120 and shown collectively in FIG. 3 as 130). The fixture mounting assembly (130) provides a convenient, aesthetically pleasing mechanism for installing fixtures (e.g., lights, electrical sockets, spigots, hose bibs and vents) to the side of a building that is to be covered with protective siding. Without limiting the invention to any one use, the fixture mounting assembly (130) provides a continuous and consistent appearance when used with fiber cement siding (i.e., HardiPlank™). The invention also provides additional protective features to ensure that the utility work on the outside of the house is protected from the elements. In this regard, the fixture mounting assembly (130) includes an integral flashing component (103) around at least a portion of the fixture mounting assembly (130).

The overall fixture mounting assembly (130) includes two separable parts—a wall mounting bracket (100) and mounting block (120). The wall mounting bracket (100) includes, at a minimum, a front face (101) that defines a mounting bracket opening (109) within an inner edge (102). In one embodiment, the front face (101) may be generally recessed within the overall bracket (100) such that the front face (101) is surrounded by a substantially perpendicular inner wall (not shown). The front face (101) is also surrounded, at least in part, by a flange (107) integral with the mounting bracket body (100). The flange (107) includes openings (106) for nailing, screwing, or otherwise attaching the mounting bracket (100) to the outside wall of the building.

Significantly, the mounting bracket (100) includes an integral flashing component (103) that provides a useful path for rain or other drainage over the associated mounting block (120) when the fixture mounting assembly is fully intact (see Ref 130). The flashing component (103) extends outwardly at an angle from the mounting bracket (100) and over the mounting bracket opening (109). In a preferred embodiment the flashing component (103) extends from just below the uppermost inner edge of the flange (107). The flashing component (103) may also include a gusset (105) for support and a bottom (104) extending substantially parallel to the front face (101) of the mounting bracket (100). The angled top portion (103A) of the flashing component (103) connects to the gusset (105) and the bottom (104) of the flashing component. The gusset (105) and the bottom (104) of the flashing component together define a peripheral edge (113) of the flashing component. The flashing component (103), therefore, defines a cavity (103B) under an overall drip cap that extends over the mounting bracket opening (109) in the front face (101).

The mounting bracket (100) may be formed by any number of techniques known in the art today. In a most preferred embodiment, the mounting bracket (100), including the front face (101), the flange (107) and the flashing component (103) are all formed in a single piece construction. Such single piece construction may be accomplished by injection molding a plastic or any polymeric material used in the art today.

The overall fixture mounting assembly (130) incorporates a detachable mounting block (120). The mounting block (120) is preferably formed of the same material as the siding used on the outside of the building. In a particular embodiment, the mounting block (120) is a substantially rectangular section of fiber cement with a hollow opening defined therein by an inner wall (121). The hollow opening (129) in the mounting block (120) is useful to allow access through the mounting block and the front face opening (109) of the mounting bracket (100) (i.e., the mounting bracket opening (109)). The outer wall of the building then includes a corresponding opening for utility access.

In use, the mounting block (120) fits over the mounting bracket (100) and into the cavity defined by the flashing component (103). In this way, the fixture (150) protruding from the wall (155) of the building extends through the mounting bracket opening (109) and fits against the second opening (129) defined by the mounting block (120). In one embodiment, the fixture (150) engages the second opening (129), also referred to above as hollow opening (129) for a secure, substantially snug fit within the mounting block (120). In other words, the top edge (124) of the mounting block (120) slides into the flashing component (103) between the gusset (105) and the bottom (104) connected to the flashing component (103). A securing mechanism such as a nail, staple, or screw is optionally driven through the back side of the mounting bracket (100) into the mounting block (120) to ensure a secure engagement between the two when the assembly is used as shown in FIG. 3.

The invention includes an embodiment by which the fixture (150, 151) protruding from the wall (155) of a building engages the mounting block (120) for protection. To enhance the protective nature of the mounting block (12), the mounting block is constructed of a uniform thickness (e.g., 1 inch) and may be formed of substantially the same material as the protective siding to be applied to the building. In one embodiment, the mounting block is significantly thicker than the siding, meaning that upon installation, the mounting block juts outwardly from the protective siding on the building. By engaging the fixture (150, 151) in a relatively snug fit, and by extending outwardly from the siding on the building, the mounting block provides additional protection that is enhanced by its uniform thickness. Without limiting the invention, the term "thickness" as used herein includes its usual meaning as a measurement (i.e., the distance from a rear face of the mounting block next to the mounting bracket to an opposite outward face of the mounting block that is exposed upon installation).

Figure 6:
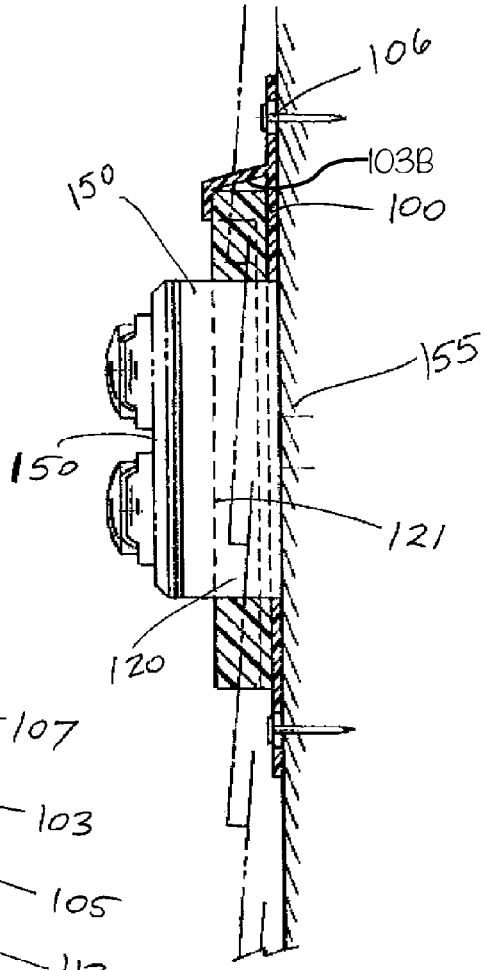
FIG. 6 is a cross section view of the mounting assembly and fixture of FIG. 5.
Figure 5:
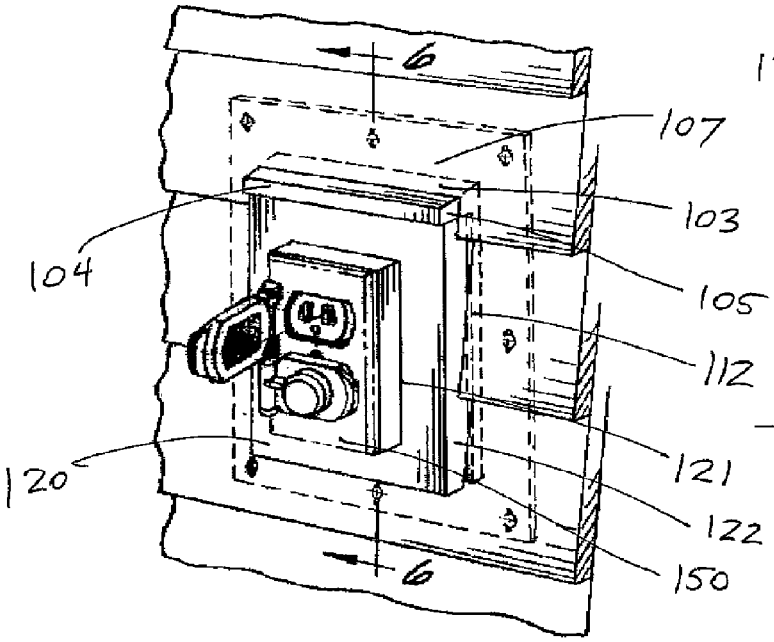
FIG. 5 is a perspective view of the mounting assembly of FIG. 3 positioned around a fixture protruding from the wall of a building covered in siding.

The fixture at issue, whether it is a light, a spigot, or any type of utility mechanism, can be installed through the wall (155) of the building and the front face opening (109) in the mounting bracket. The fixture (150, 151) is mounted to the building via the mounting bracket opening (109) and the hollow opening, or second opening (129), in the mounting block (120). In this respect, the overall mounting assembly (130) with the fixture (150, 151) therein can be attached to the outer wall (155) of the building via the flange (107) (i.e., the flange is nailed to the building as in FIG. 6). After the fixture and mounting assembly (130) are attached to the building, the siding may be installed such that the flange (107) is completely covered, and the siding (e.g., HardiPlank™) is installed right up to each side (e.g., 122) of the mounting block (120). The completed mounting assembly (130) includes the integral flashing component (103) that provides a protective cover for the mounting block (120) and a continuous aesthetic appearance in which the mounting block (120) and the siding on the building match.

Figure 7:
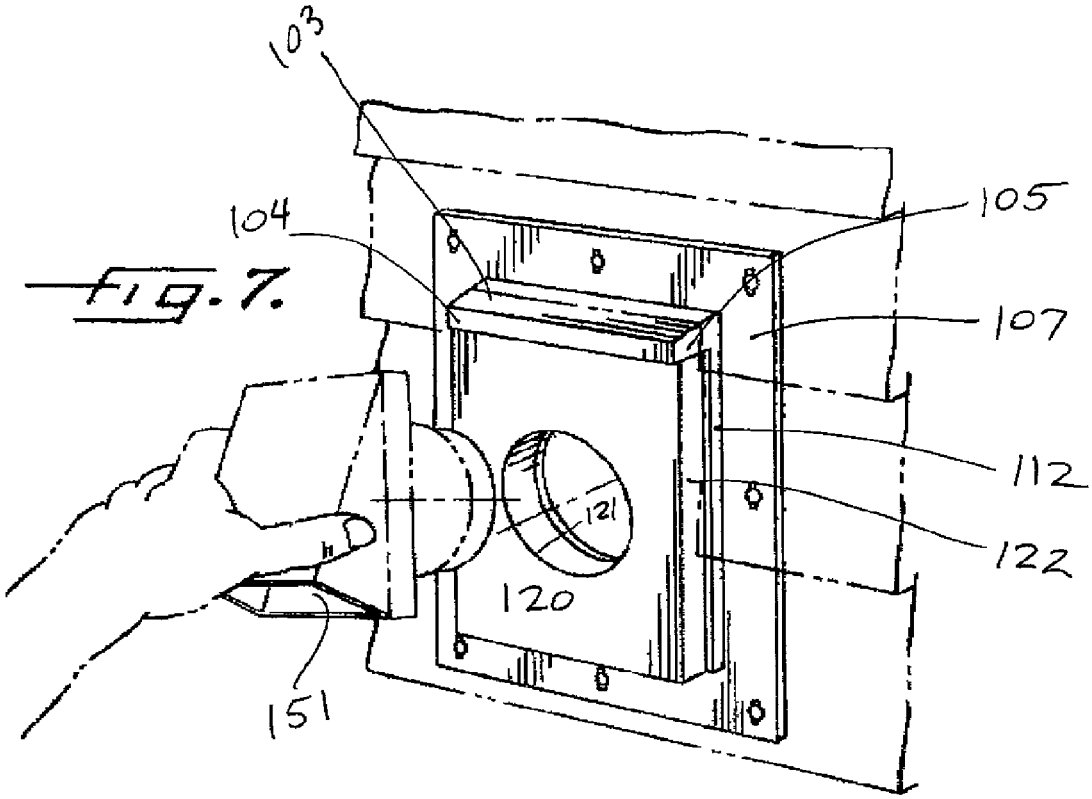
FIG. 7 is a perspective view of the mounting assembly according to this invention with the mounting block adapted for a round fixture.
Figure 8:
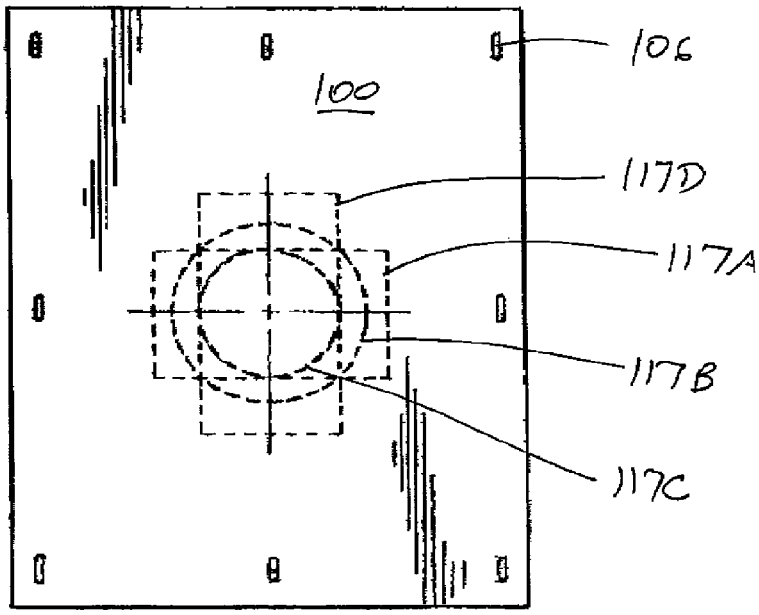
FIG. 8 is a rear view of the mounting assembly of FIG. 7 with additional views of other shapes possible for the opening therein.

In one embodiment, the mounting bracket (100) includes the front face opening (109) in a standard size that is useful for multiple fixtures. The mounting block (120), however, may have a hollow opening (second opening (121)) that is sized according to the fixture at hand. The hollow opening within the mounting block may be of any desirable shape or size that the consumer needs or that the project requires. For example, FIGS. 7 and 8 show the use of a round opening in the mounting assembly.

In a different embodiment, the mounting bracket (100) may be manufactured with a front face (101) that is substantially solid—in other words, without the front face opening (109). On the back side of the mounting bracket (100), however, the mounting bracket includes perforations (117), or scoring, to show different shapes of mounting bracket openings (109) that may be cut out. In this embodiment, the scoring (117) may be in the form of intermittent cuts in the mounting bracket (100) body. The user then completes the cut to form a mounting bracket opening (109) that tracks one of the available scored designs (117A-117D) on the back of the mounting bracket (100. This embodiment allows more than one type of mounting bracket (100) to be formed from the same overall piece, depending upon the application at hand. FIG. 8 shows these perforations (117) on the back of the mounting bracket (100).

FIG. 1 also shows an embodiment of the fixture mounting assembly according to this invention and includes side rails (111, 112) for additional weather protection between the protective siding on the building and the mounting assembly. The side rails (111, 112) run vertically from the gusset (105) supporting the flashing component (103) toward the bottom of the wall mounting bracket (100). In any of these embodiments, the pieces may be formed integrally for a one piece construction.

Just as noted above, the overall fixture mounting assembly of FIG. 3 and FIGS. 5-7 includes two separable parts—a wall mounting bracket (100) and mounting block (120). The wall mounting bracket (100) includes, at a minimum, a front face (101) that defines a mounting bracket opening (109) within an inner edge (102). The front face (101) is generally separated into portions on one side of the overall bracket (101) such that the front face includes a flange or flange-like area (107) on one side of the sealing inner edge (102) and the mounting bracket opening (109) on the other side of the sealing inner edge (102).

To describe the wall mounting bracket another way, the mounting bracket has a pair of side rails (111, 112) on either side of the flashing component (103). These side rails (111, 112) are barriers on either side of the mounting bracket opening (109).

The front face is also surrounded, at least in part, by a flange (107) integral with the mounting bracket body. The flange (107) includes openings (106) for nailing, screwing, or otherwise attaching the mounting bracket to the outside wall of the building.

Significantly, the mounting bracket (100) includes an integral flashing component (103) that provides a useful path for rain or other drainage over the associated mounting block (120) when the fixture mounting assembly (100) is fully intact. The flashing component (103) extends outwardly at an angle from the mounting bracket. In a preferred embodiment the flashing component (103) extends from just below the uppermost inner portion of the flange (107) and covers an upper area of the front face (101). The flashing component (103) may also include a gusset (105) for support and a bottom (104) extending substantially parallel to the front face (101) of the mounting bracket (100).

In practice, the mounting block (120) fits between the side rails (111, 112) and within the flashing component (103). The mounting block (120) is attached to the mounting bracket (100) by a staple or other attachment mechanism. In use, the mounting block (120) is attached to the mounting bracket (100) by a staple from the back side of the face of the mounting bracket.

Figure 9A:
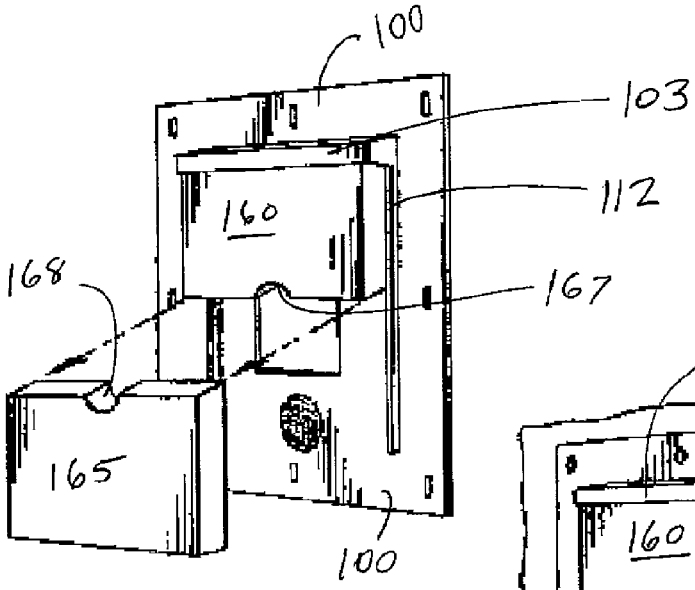
FIG. 9A is an exploded view of a mounting assembly according to this invention with the mounting block in separable pieces.
Figure 9B:
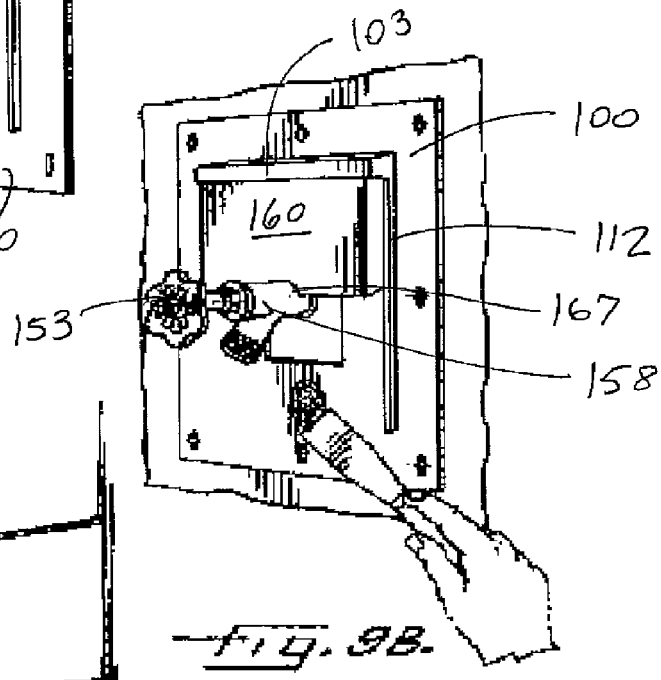
FIG. 9B is a perspective view of a mounting assembly according to this invention with a separable mounting block according to FIG. 9A and having an upper portion of the mounting block in place around a hose bib protruding from a wall of a building.
Figure 9C:
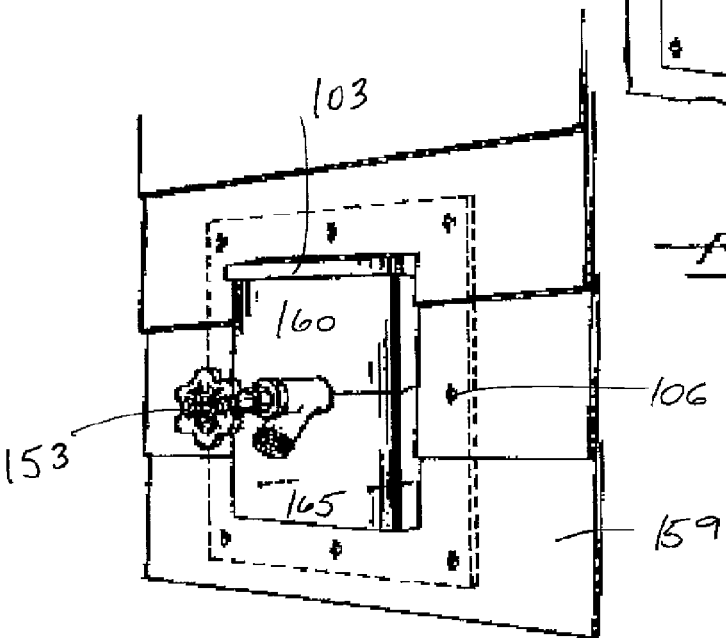
FIG. 9C is a perspective view of the mounting assembly of FIG. 9A in place around a hose bib.

The overall invention shown in FIGS. 1-8 sets the background for additional features included in the mounting bracket assembly (130). For example, as shown in FIGS. 9A, 9B, and 9C, the same mounting bracket (100) can be used in a system by which the mounting block (120) is separated into two portions (160, 165). The portions include arcuate indentions (167, 168) that together form the second opening, i.e., the mounting block opening, through which a fixture (153) fits. This embodiment is particularly useful in installing the mounting assembly around a hose bib or a drip pipe, where the goal is to allow the inner edge of the mounting block to engage the fixture snugly for protection. By forming the mounting block in two sections (160, 165), the fixture is more conveniently installed through the second opening in the mounting assembly.

In practice, the manufacturer may choose to ship the mounting assembly in the following manner. First, the upper portion (160) of the mounting block is attached to the mounting bracket (100) and engages the flashing component (e.g., the drip cap) (103) via the cavity (103B) formed by the top (103A), bottom (104), and gusset (105) of the flashing component (103). The bottom portion (165) of the mounting block (120) is temporarily attached to the mounting bracket (100) by glue or some other removable adhesive. At the construction site, the installer removes the bottom component (165) and scrapes off the glue pad as shown in FIG. 9B. The mounting bracket (100) with the top portion (160) of the mounting block installed therein is placed over the fixture (153), such as a spigot shown in FIG. 9B and FIG. 9C. The installer then attaches the mounting block bottom portion (165) around the spigot and attaches the bottom portion (165) to the mounting bracket (100) by known means (e.g., nails or tacks). Again, the mounting block (160, 165) defines a precisely dimensioned second opening in the mounting assembly that engages the fixture (153) extending there through. Such a complete fit around the fixture enhances the protection that the mounting assembly offers to the elements or unexpected leaks. Again, the protective siding is installed adjacent the mounting block. In one embodiment, the protective siding is installed in direct contact with the side rails on the mounting bracket.

Figure 10A:
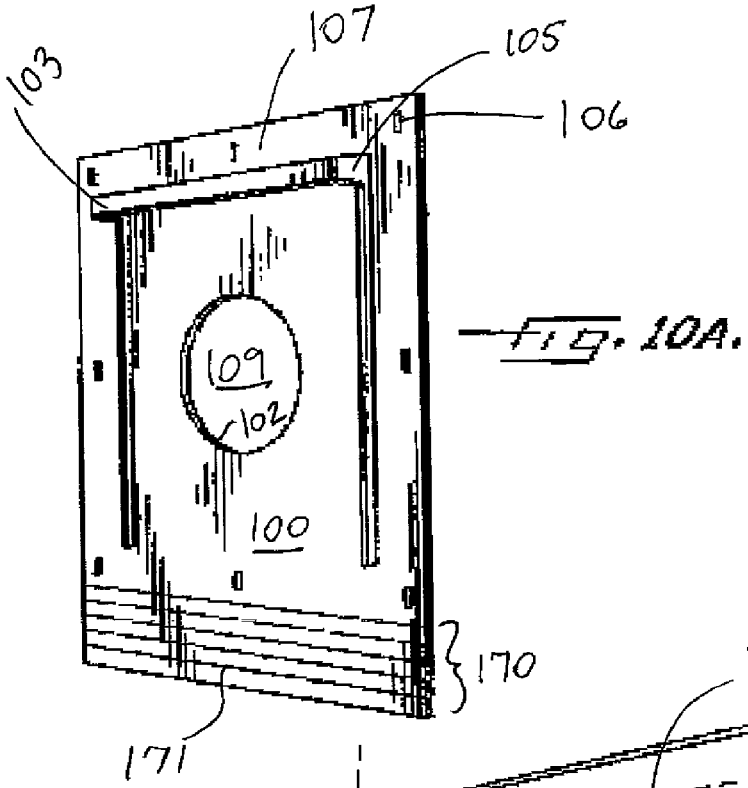
FIG. 10A is a perspective view of the mounting bracket according to this invention with a trim extension thereon.
Figure 10B:
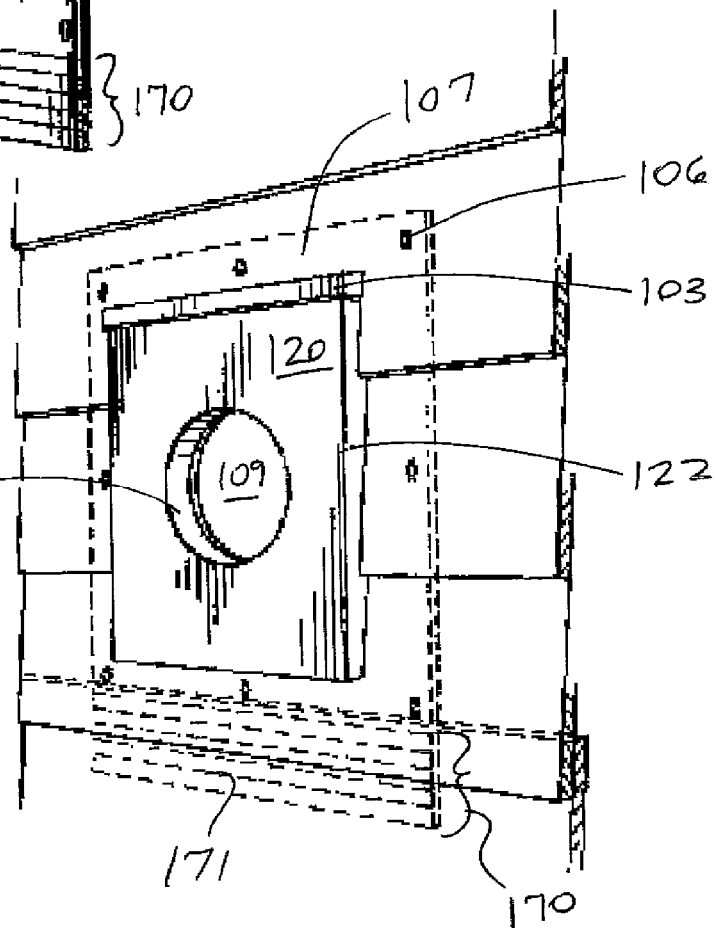
FIG. 10B is a perspective view of the mounting bracket according to this invention with a mounting block installed over a trim extension on the bracket.

FIGS. 10A and 10B show yet another feature that is optionally included in the mounting assembly of this invention. FIG. 10A shows the mounting bracket (100) just as described above, but with the addition of a trim extension (177) at the bottom of the bracket (100). The trim extension is useful as a replacement for standard trim coil used as flashing around the fixture installation. In a typical bracket installation of the prior art, a bracket around the fixture of a building is positioned over a lining, or a layer of trim coil, that protects the area under the fixture. In one prior embodiment, the trim coil is a sheet of aluminum over the wall of the building and under the bracket supporting the fixture. The trim extension (170) shown in FIGS. 10A and 10B eliminates the need for the standard trim coil installed under the bracket. The trim extension (170) is meant to be hidden by the protective siding on the building, and protective siding comes in a variety of dimensions. Accordingly, the trim extension (170) shown in FIGS. 10A and 10B is scored to allow the installer to size the trim extension (170) according to the use at hand. The installer simply completes the scored cuts (171) shown in the figures, breaks off the excess trim extension (170), and uses the mounting bracket (100) with a trim extension (170) in place of a mounting bracket plus a layer of trim coil.

Figure 11A:
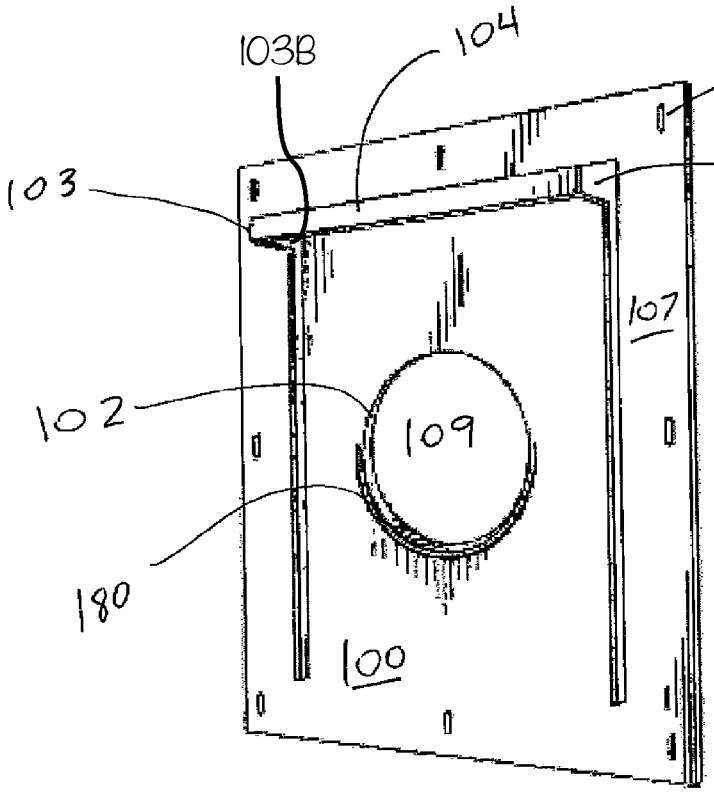
FIG. 11A is a perspective view of the mounting bracket of this invention having a lip extending from an opening in the mounting bracket.
Figure 11C:
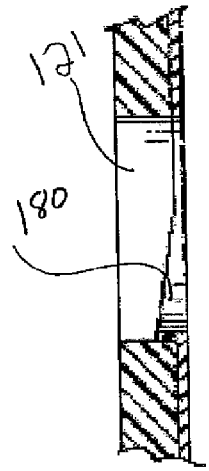
FIG. 11C is a cross section of the mounting assembly of FIG. 11B.
Figure 11B:
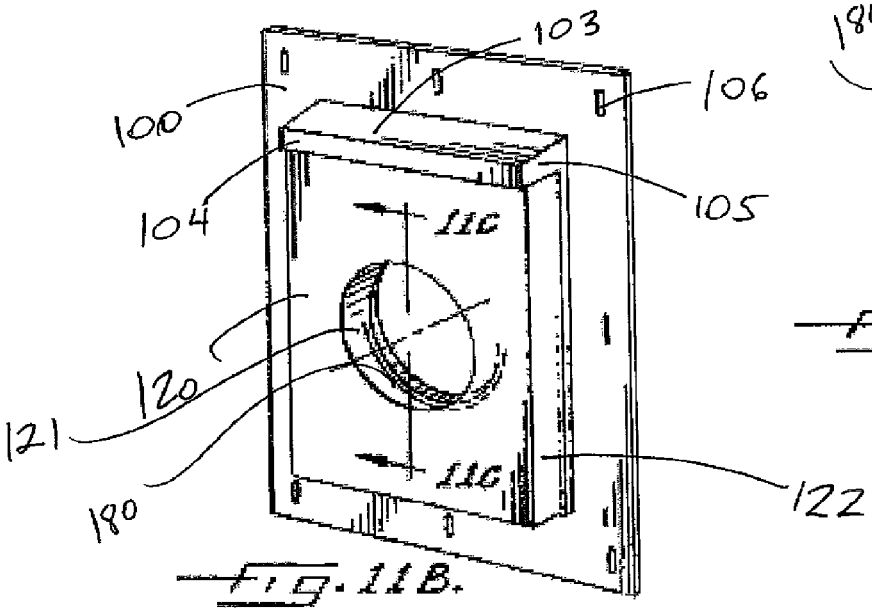
FIG. 11B is a perspective view of the mounting bracket of this invention having a mounting block in place with the mounting bracket of FIG. 11A and engaging the lip.

Yet another sealing feature available in this invention is a lip or ridge (180) that may extend from the mounting bracket (100) from the inner edge (102) defining the mounting bracket opening. In this embodiment, the lip (180) is designed to engage the inner surface of the second opening (129) of the mounting assembly (130), i.e., the opening in the mounting block (120). Again, this lip engagement provides even more sealing qualities and protection from the elements for the fixture engaging the mounting block. The lip of the mounting bracket is illustrated in FIGS. 11A-11C.

In the drawings and specification there has been set forth a preferred embodiment of the invention, and although specific terms have been employed, they are used in a generic and descriptive sense only and not for purposes of limitation. The invention is further described by the following claims.

The invention claimed is:

1. A mounting assembly for use in protecting a fixture connected to an outside wall of a building, the mounting assembly comprising:

a mounting bracket for attaching to the wall of the building, said mounting bracket defining a mounting bracket opening for the fixture to fit through the mounting bracket;

a flashing component extending from said mounting bracket over the mounting bracket opening; and a detachable mounting block connected to said mounting bracket and defining a second opening for receiving the fixture;

said flashing component having an angled top portion defining a cavity; and said mounting block fitting over said mounting bracket and having a top edge fitting into said cavity below said angled top portion so that said flashing component directs rain over said mounting block.

2. A mounting assembly according to claim 1, wherein said mounting block comprises a substantially uniform thickness from a rear surface that engages said mounting bracket to an outer surface opposite said rear surface.

3. A mounting assembly according to claim 1, further comprising at least one side rail connected to said mounting bracket and extending from said flashing component toward a side of said mounting bracket opposite said flashing component.

4. A mounting assembly according to claim 1, further comprising a pair of side rails connected to said mounting bracket and extending from said flashing component toward a side of said mounting bracket opposite said flashing component.

5. A mounting assembly according to claim 1, wherein said mounting block is detachable from said mounting bracket.

6. A mounting assembly according to claim 1, wherein said mounting bracket further comprises a lip extending from an inner edge defining the mounting bracket hole, wherein said lip engages the second opening of the mounting block.

7. A mounting assembly according to claim 1, wherein said mounting bracket and said flashing component are formed of plastic and said mounting block is formed of fiber cement.

8. A mounting assembly according to claim 1, wherein said mounting bracket further comprises a trim extension extending from an edge of said mounting bracket opposite said flashing component.

9. A mounting assembly according to claim 8, wherein said trim extension comprises a plurality of sizing scores.

10. A mounting assembly according to claim 1, wherein said mounting bracket includes a front face with said angled top portion extending from said front face and wherein said flashing component has a bottom portion extending from said angled top portion substantially parallel to said front face and spaced from said front face.

11. A mounting assembly according to claim 10, wherein said flashing component includes a pair of gussets connecting said angled top portion, said bottom portion, and said front face to define said cavity therebetween.

12. A mounting assembly according to claim 11, further comprising a side rail extending from each gusset along said front face toward a bottom of said mounting bracket.

13. A mounting assembly according to claim 1, wherein said mounting block comprises two portions.

14. A mounting assembly according to claim 13, wherein each portion comprises an angled edge.

15. A mounting assembly according to claim 13, wherein said portions fit together on said mounting bracket to define the second opening of the mounting block.

16. A mounting assembly according to claim 15, wherein a first portion of said mounting block connects to said mounting bracket by fitting under said flashing component, and a second portion of said mounting block is removably connected to said mounting bracket adjacent said first portion.

17. A mounting assembly according to claim 16, wherein said portions of said mounting block fit around a fixture selected from a hose bib, a drip pipe, and a spigot.

18. A mounting bracket for use in providing protection to a fixture extending from an outside wall of a building through a mounting bracket opening and a mounting block that fits around the fixture, the mounting bracket comprising:

a front face;

a flashing component extending from said front face, said flashing component defining a drip cap for positioning over the fixture, said flashing component including:

an angled top portion that is planar; and a bottom portion extending from said angled top portion substantially parallel to said front face defining a cavity for receiving the mounting block.

19. A mounting bracket according to claim 18, further comprising a pair of side rails connected to said mounting bracket and extending from said flashing component toward a side of said mounting bracket opposite said flashing component.

20. A mounting bracket according to claim 18, wherein said mounting bracket further comprises a trim extension extending from an edge of said mounting bracket opposite said flashing component and including a plurality of sizing scores.

21. A mounting bracket according to claim 18, comprising a continuous front face having scored cuts defining optionally sized mounting bracket openings.

* * * * *